US005988229A

United States Patent [19]

Quigley

[11] Patent Number: 5,988,229

[45] Date of Patent: Nov. 23, 1999

[54] PAPERMAKERS FORMING FABRIC WITH WEFT DOMINATED PAPER SUPPORT SURFACE

[75] Inventor: Scott D. Quigley, Townville, S.C.

[73] Assignee: Wangner Systems Corporation, Greenville, S.C.

[21] Appl. No.: 09/137,384

[22] Filed: Aug. 20, 1998

[51] Int. Cl.[6] ..... D03D 13/00

[52] U.S. Cl. ..... 139/383 A; 442/207

[58] Field of Search ..... 139/383 A; 442/207, 442/203

[56] References Cited

U.S. PATENT DOCUMENTS

| | | | |
|---|---|---|---|
| 4,709,732 | 12/1987 | Kinnunen | 139/383 A |
| 4,739,803 | 4/1988 | Borel . | |
| 5,025,839 | 6/1991 | Wright . | |
| 5,067,526 | 11/1991 | Herring | 139/383 A |
| 5,094,719 | 3/1992 | Fry . | |
| 5,555,917 | 9/1996 | Quigley . | |
| 5,713,397 | 2/1998 | Quigley . | |
| 5,857,498 | 1/1999 | Barreto et al. | 139/383 A |

*Primary Examiner*—Andy Falik

*Attorney, Agent, or Firm*—Henry S. Jaudon; Cort Flint

[57] ABSTRACT

A forming fabric for use in papermaking machines having a paper support surface and a machine contact surface. The support surface comprises first weft yarns interwoven in a weaving pattern with warp yarns to form a weft dominated surface having alternating weft floats of first and second lengths. These floats are formed by the first weft yarns passing over different numbers of adjacent warp yarns in each pick of the weft across the weave pattern. The contact surface is woven with the second weft yarns weaving with the warp yarns in a weave pattern which also forms a weft dominated surface. The second weft yarns are passed under a greater number of adjacent warp yarns in each pick across the weave pattern than the first weft yarns are passed over forming the contact surface with very long weft floats.

16 Claims, 4 Drawing Sheets

PAPERMAKERS FORMING FABRIC WITH WEFT DOMINATED PAPER SUPPORT SURFACE

BACKGROUND OF THE INVENTION

The present invention is directed to papermaking fabrics and particularly to two-layered forming fabrics for use in the forming section of papermaking machines.

Modern papermaking machines operate at speeds unheard of in years past. Multi-layer forming fabrics of monofilament synthetic yarns are gaining increased popularity due to their durability, flexibility and good drainage properties. However, it has been found that paper formed on these fabrics has a tendency, at times, to appear streaky and uneven in color. In general, it is believed that these defects are caused by uneven drainage and poor or uneven fiber support, both due to movement of the fabric forming filaments away from the relative positions in which they are woven.

Accordingly, it is an object of this invention to provide a forming fabric which produces paper which is substantially free of the above defects.

Another object of the invention is a forming fabric in which the forming filaments are interlaced in a weave pattern which provides a more stable structure.

Another object of the invention is a forming fabric having a paper fiber support surface of uniform texture.

Another object of the invention is a forming fabric with superior wear resistance.

Another object of the invention is a forming fabric with cross-direction stability.

Another object of the invention is a forming fabric with even drainage.

Another object of the invention is a forming fabric having a weft dominated paper fiber support surface.

Another object of the invention is a forming fabric having a weft dominated contact surface.

Another object of the invention is a forming fabric woven in a sixteen harness weave construction.

SUMMARY OF THE INVENTION

The papermaking forming fabric of the invention is woven with a sixteen harness pattern. The forming fabric includes an upper paper support surface and a lower machine contact surface.

There are two sets of weft yarns interwoven with a set of warp yarns. The upper weft yarns weave with the warp yarns to form a weft dominated support surface in which the warp yarn crosses over at least two of the upper weft yarns in each repeat of the weave pattern. The lower weft yarns weave with the warp yarns to form the contact surface which is also weft dominated. In the contact surface, each warp yarn crosses under at least two of the lower weft yarns in each repeat of the weave pattern.

The crossovers and crossunders of the warp yarns form diagonal twill lines across both the support and the contact surfaces.

In the support surface, each warp yarn crosses over four picks of the upper weft yarns in each repeat of the weave pattern. Also, in the contact surface, each crossunder of the warp yarn beneath a lower weft yarn is separated from an adjacent crossunder by a single warp yarn.

The support surface is formed with two sets of twill lines. Alternate ones of the twill lines are formed with half the number of crossovers as are formed in the intermediate ones of the twill lines.

The forming fabric is formed with twice the number of upper weft yarns as there are lower weft yarns. First ones of the upper weft yarns are disposed vertically over each of the lower weft yarns while second ones of the upper weft yarns are disposed intermediate of the lower weft yarns.

The first ones of the upper weft yarns may be of a diameter different than that of the second ones of the upper weft yarns.

The lower weft yarns have a diameter which is at least as large as the diameter of at least certain of the upper weft yarns.

The weft dominated support surface contains floats of the upper weft yarn crossing over four and ten warp yarns in each pick across the weave pattern. The contact surface contains a single weft float beneath the warp yarns in each pick across the weave pattern which crosses under at least ten consecutive warp yarns.

DESCRIPTION OF A PREFERRED EMBODIMENT

Referring now in more detail to the drawings, the invention will now be described in more detail.

Figure 1:
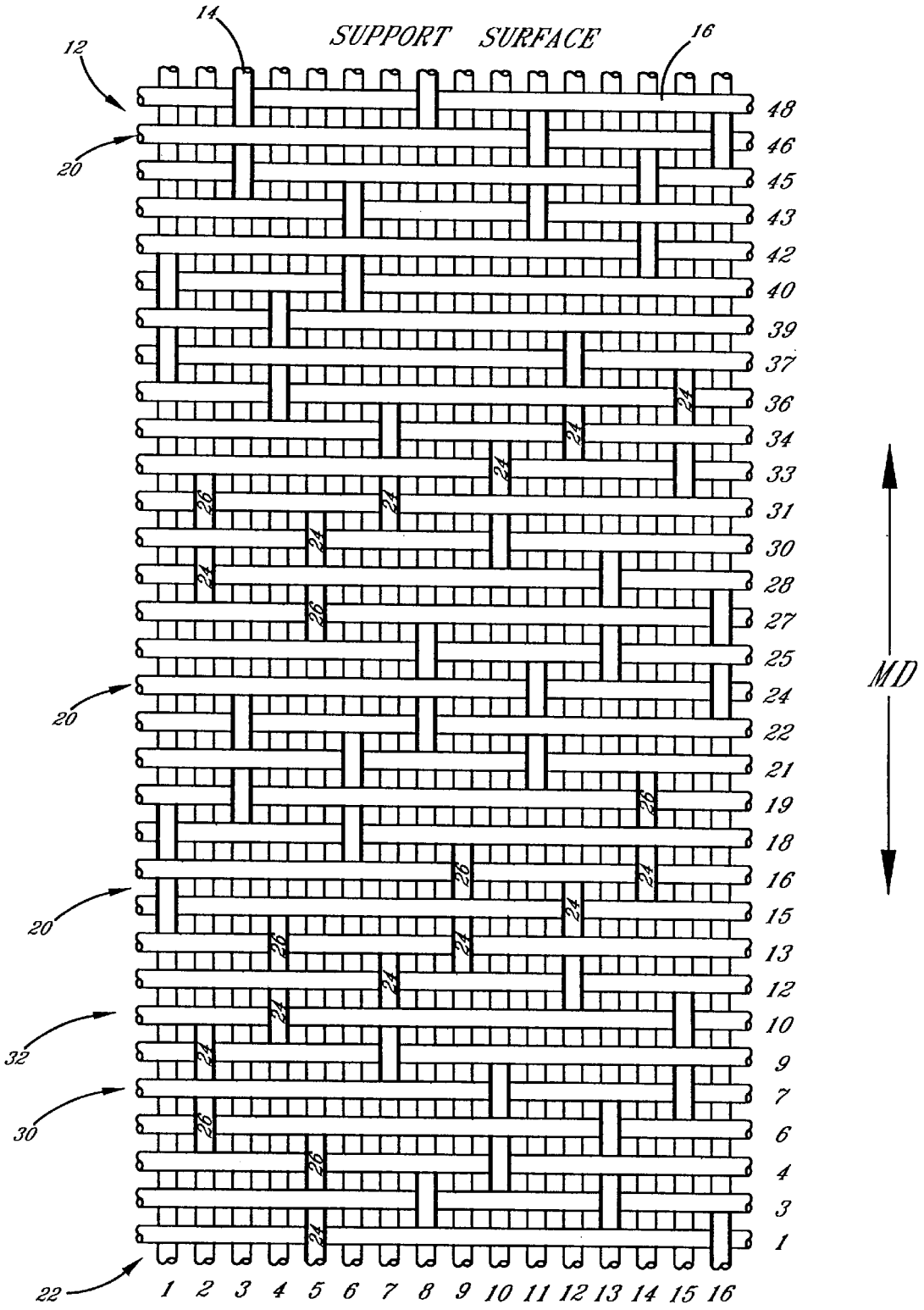
FIG. 1 is a top view of the support surface of the forming fabric.

Turning now to FIG. 1, which is, a sectional top view of the support surface 12 of the forming fabric of the invention, shown in a single repeat of the weave pattern. It can be seen that the weave pattern includes sixteen warp yarns 14, numbered 1–16, which are arranged from right to left across the repeat of the weave pattern.The forming fabric includes a selected number of repeats of the weave pattern arranged side by side across the fabric width. Also shown, in FIG. 1, are the thirty-two top or upper weft yarns 16 numbered 1–48, and arranged in the sequence in which they are interwoven with the warp yarns according to the weave pattern. This structure will be described in more detail hereinafter.

Figure 2:
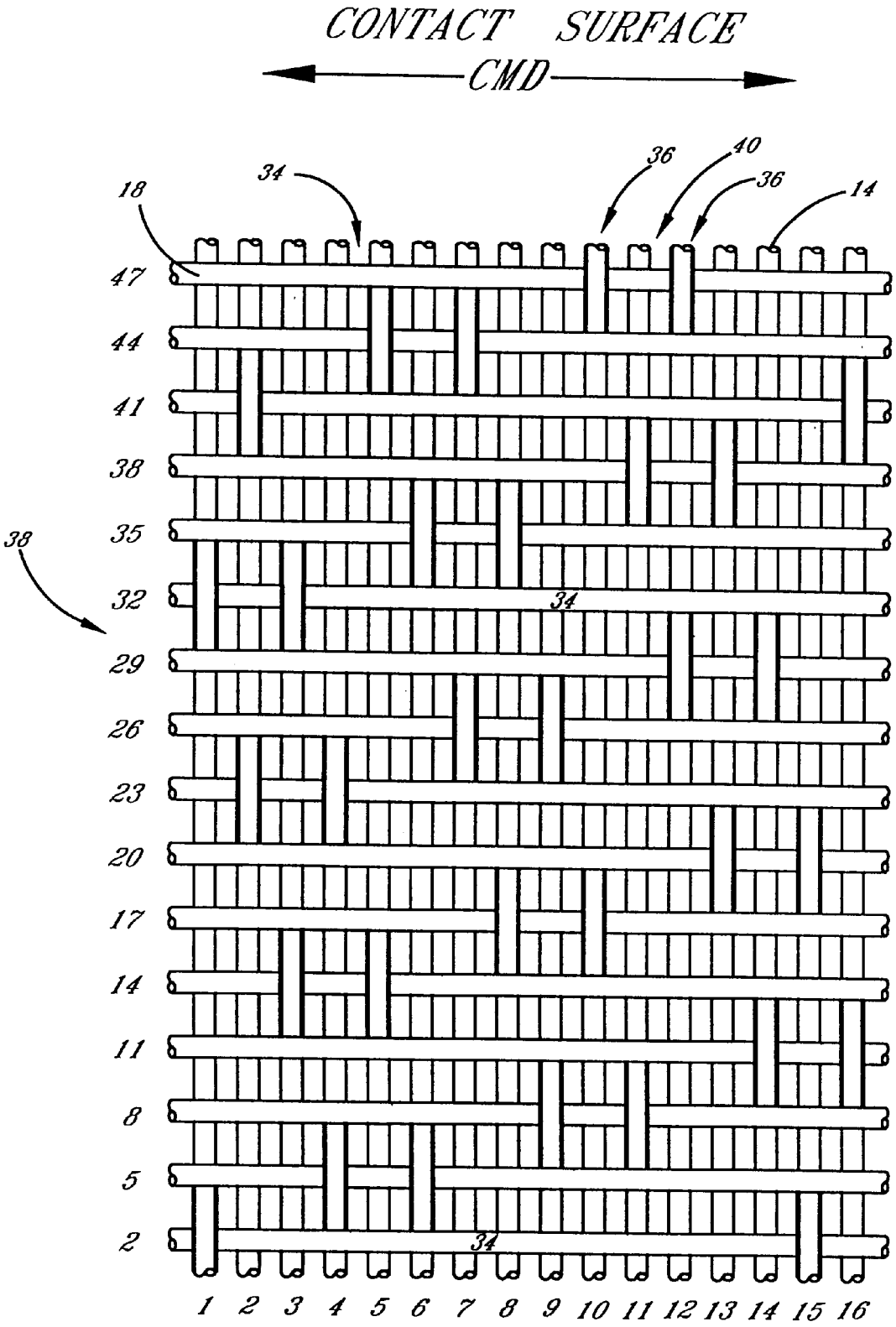
FIG. 2 is a bottom view of the contact surface of the forming fabric.

FIG. 2 is a sectional bottom view of a single repeat of the weaving pattern forming the contact surface 38 of the forming fabric of the invention. Again, the sixteen warp yarns are identified as 14 and numbered 1–16 as they appear in the weave pattern. There are shown sixteen bottom or lower weft yarns 18, numbered 2–47, arranged as they appear in the weave pattern. This structure will also be described in more detail hereinafter.

Figure 3:
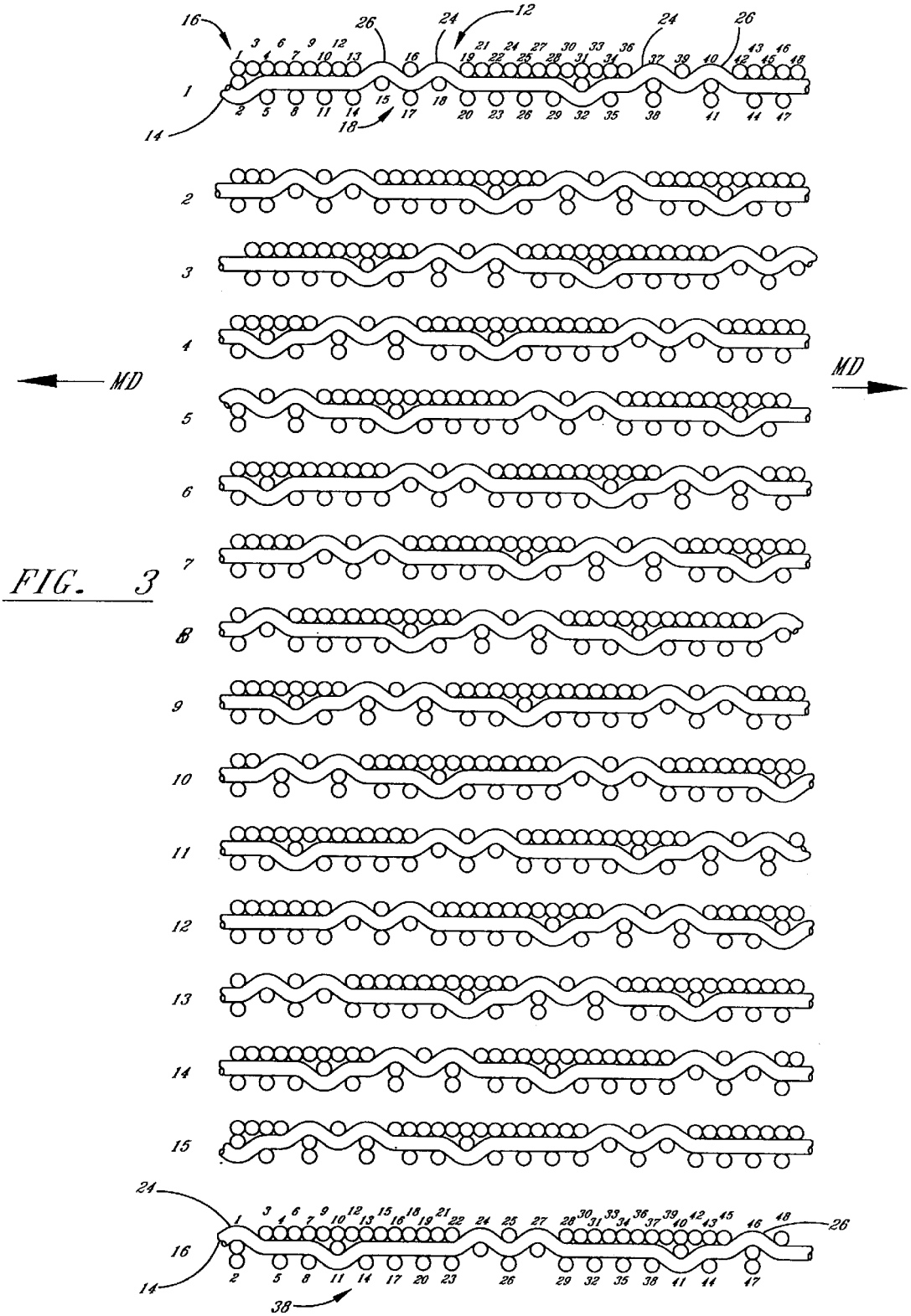
FIG. 3 is a side view showing the warp weft relationship of each warp yarn of the weave pattern.

Turning now to FIG. 3, along with FIGS. 1 and 2, the structure of the forming fabric will be described in more detail. A primary object of the forming fabric as disclosed is to provide a paper fiber support surface which is even, has a uniform pattern and is stable. All of these objects combine to produce a paper product with a uniform texture and one in which the marking is uniform and at a minimum.

It has been found that the fewer crimps placed in the warp yarns and the less these yarns appear on the outer surfaces, provides for a more even surface and for more longitudinal stability. This is because the number of knuckles and the degree of stretch and wear are kept to a minimum. It is also important that the yarns serving primarily on the support surface be controlled to the position in which they are woven.

The weave structure of the forming fabric of the invention performs these functions.

As seen in FIGS. 1 and 3, weft yarns 16 are arranged in a series of floats 20 and 22 in each pick across the weave pattern. Floats 20 pass over ten adjacent warp yarns 14 while floats 22 pass over four warp yarns. This provides that support surface 12 is a weft dominated surface.

Each of warp yarns 14 are controlled to pass over a single top weft yarn 16 at four longitudinally spaced points throughput the weave pattern. FIG. 3 clearly shows each warp yarn of warp yarns 14 passing under twelve adjacent top weft yarns 16 and then under fourteen adjacent of the top weft yarns in each repeat of the weave pattern. Each one of these floats beneath weft yarns 16 is separated by a pass of the warp yarn over, under and over three consecutive weft yarns 16 forming knuckles 24 and 26. It is noted that in each warp yarn, if the first formed knuckles are in the sequence 24, 26, the second formed knuckles are in the reversed sequence, 26, 24. If the first formed sequence is 26, 24, then the second formed sequence is 24, 26. This construction is true throughout the weave patten.

As shown in FIG. 1, knuckles 24 are diagonally aligned across the weave pattern forming twill row 30 while knuckles 26 are diagonally aligned across the weave pattern forming twill row 32. The twill rows form a symmetrically pleasing marking pattern on the paper being formed. The relative disposition of knuckles 24 and 26 throughout the weave pattern repeat controls the weft yarns to form weft floats which form an even smooth surface to over the support surface to support the paper forming fibers.

Turning now to FIGS. 2 and 3, and contact surface 38. It can be seen that lower weft yarns 18 form only a single float 34 over the contact surface. Float 34 passes beneath thirteen consecutive warp yarns 14 on each pick through the weave pattern. Each of the floats 34 are secured in position by a pair of crossunders 36. Each crossunder 36 is separated by a crossover 40 of an intermediate warp yarn 14 forming lower binding knuckles at the end of each float 34. There are two knuckles or crossunders 36 formed in each warp yarn 14 throughout each weave pattern.

Figure 4:
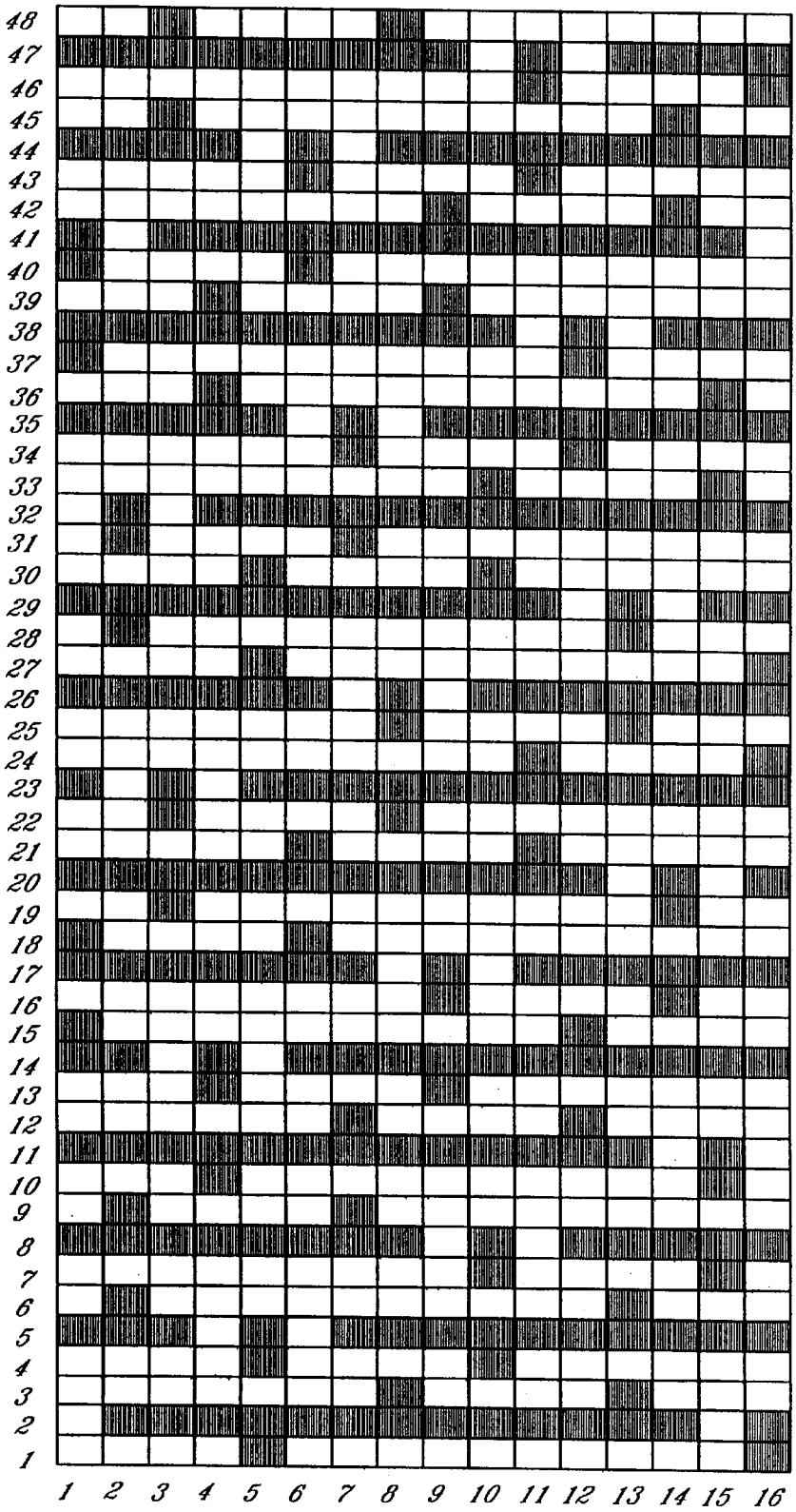
FIG. 4 is the weave pattern.

FIG. 4 is the weave diagram indicating the positions of each yarn through a repeat of the weave pattern.

It is noted that there are twice the number of upper weft yarns as lower weft yarns. Normally, the upper weft yarns are of one size, however, they may be sized with alternate ones being larger than intermediate ones. The lower weft yarns, which are normally arranged beneath the alternate or intermediate ones of the upper weft yarns, are preferably of a size larger than that of the upper weft yarns. Alternatively, the lower weft yarns may be of equal size or smaller than the upper weft yarns.

The warp and weft yarns are preferably formed of monofilament polyester, although multi-filament yarns and or other suitable synthetic materials may be used. The yarns may be configured to have a rectangular or circular cross section in one or both yarn directions.

The forming fabric of the invention is woven to have a porosity of between 600 to 900 CFM with a warp and weft density ranging between 5 and 200 per inch in each fabric layer.

While a preferred embodiment of the invention has been described using specific terms, such description is for illustrative purposes only, and it is to be understood that changes and variations may be made without departing from the spirit or scope of the following claims.

What is claimed is:

1. A sixteen harness forming fabric woven in a weave pattern including:

an upper paper support layer and a lower machine contact layer, said fabric having upper weft yarns interweaving with warp yarns to form a weft dominated support surface in which each said warp yarn crosses over at least two of said upper weft yarns forming a plurality of warp yarn crossovers in each repeat of said weave pattern, each said warp yarn crossover being separated from an adjacent warp yarn crossover by a single upper weft yarn and lower weft yarns interweaving with said warp yarns to form a weft dominated contact surface in which each said warp yarn crosses under no more than two of said lower weft yarns in each repeat of said weave pattern, said crossovers and crossunders forming diagonal twill lines across said support and contact surfaces.

2. The fabric of claim 1: wherein the number of upper weft yarns forming said support surface is twice the number of lower weft yarns forming said contact surface.

3. The fabric of claim 1: wherein each said warp yarn crosses over four weft yarns of said upper weft yarns in each repeat of said weave pattern.

4. The fabric of claim 1: wherein first ones of said twill lines formed in said support surface contain half the number of crossovers as do second ones of said twill lines.

5. The fabric of claim 1: wherein there are twice the number of upper weft yarns as there are lower weft yarns.

6. The fabric of claim 5: wherein first ones of said upper weft yarns are vertically disposed over each of said lower weft yarns and second ones of said upper weft yarns are disposed intermediate said lower weft yarns.

7. The fabric of claim 6: wherein said first ones of said upper weft yarns are larger than said second ones of said upper weft yarns.

8. The fabric of claim 6: wherein said lower weft yarns are at least as large as said first ones of said upper weft yarns.

9. The fabric claim 1: wherein said weft dominated support surface contains floats of said upper weft yarn passing over four and ten warp yarns in each pick of said upper weft yarns of each weave pattern repeat.

10. The fabric of claim 1: wherein said weft dominated contact surface contains floats of said lower weft yarns passing beneath at least ten adjacent warp yarns in each pick of said lower weft yarns of each weave pattern repeat.

11. The fabric of claim 1: wherein each said crossunder of said warp yarn on said contact surface is spaced from an adjacent warp yarn crossunder by a single warp yarn.

12. A forming fabric for use in papermaking machines having a paper support surface and a machine contact surface:

said support surface comprising first weft yarns interwoven in a weaving pattern with warp yarns to form a weft dominated support in which each warp yarn crosses over at least two of said first weft yarns forming a plurality of warp yarn crossovers in each repeat of said weave pattern;

second weft yarns interweaving with said warp yarns to form a weft dominated contact surface in which each said warp yarn crosses under at least two of said lower weft yarns in each pattern repeat;

said crossovers and crossunders forming diagonal first and second twill lines across said support surface, said first twill lines being formed with fewer crossovers than form said second twill lines; whereby, said forming fabric provides good fiber support, wear resistance and fabric stability.

13. The fabric of claim 12: wherein there are twice the number of first weft yarns as there are second weft yarns.

14. The fabric of claim 13: wherein alternate of said first weft yarns are of greater size that intermediate of said first weft yarns.

15. The fabric of claim 12: wherein alternate of said first weft yarns are arranged vertically of each of said second weft yarns.

16. The fabric of claim 12 wherein the number of crossovers forming said first twill line is half the number of crossovers forming said second twill line.

* * * * *